US009156274B2

(12) United States Patent
Urabe

(10) Patent No.: US 9,156,274 B2
(45) Date of Patent: Oct. 13, 2015

(54) INK SUPPLY CONTROL METHOD FOR AN INKJET PRINTER, AND AN INKJET PRINTER

(71) Applicant: Seiko Epson Corporation, Tokyo (JP)

(72) Inventor: Yuichi Urabe, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/622,406

(22) Filed: Feb. 13, 2015

(65) Prior Publication Data

US 2015/0151548 A1 Jun. 4, 2015

Related U.S. Application Data

(63) Continuation of application No. 14/051,961, filed on Oct. 11, 2013, now Pat. No. 9,033,475.

(30) Foreign Application Priority Data

Oct. 11, 2012 (JP) ..... 2012-225748
Oct. 12, 2012 (JP) ..... 2012-226677

(51) Int. Cl.
*B41J 29/38* (2006.01)
*B41J 2/175* (2006.01)

(52) U.S. Cl.
CPC ..... *B41J 2/17566* (2013.01)

(58) Field of Classification Search
CPC .... B41J 2/175; B41J 2/17556; B41J 2/17566; B41J 2/17586; B41J 2/17596; B41J 2/175195; B41J 2002/17516; B41J 2/17569
USPC ..... 347/5, 7, 19, 84, 85, 86
See application file for complete search history.

(56) References Cited

U.S. PATENT DOCUMENTS

| | | | | |
|---|---|---|---|---|
| 6,010,210 | A | 1/2000 | Wilson et al. | |
| 6,290,343 | B1 | 9/2001 | Lewis et al. | |
| 6,733,114 | B2 | 5/2004 | Kobayashi et al. | |
| 6,811,249 | B2 | 11/2004 | DeVries et al. | |
| 8,007,070 | B2 * | 8/2011 | Kaga et al. | 347/23 |
| 8,128,212 | B2 | 3/2012 | Katada et al. | |
| 2008/0218554 | A1 * | 9/2008 | Inoue | 347/33 |
| 2009/0122093 | A1 | 5/2009 | Mutoh | |
| 2014/0104350 | A1 | 4/2014 | Urabe | |

FOREIGN PATENT DOCUMENTS

| | | | |
|---|---|---|---|
| CN | 100572078 | C | 12/2009 |
| JP | 2006-062330 | A | 3/2006 |
| JP | 2009-190410 | A | 8/2009 |

* cited by examiner

*Primary Examiner* — Anh T. N. Vo
(74) *Attorney, Agent, or Firm* — Nutter McClennen & Fish LLP; John J. Penny, Jr.

(57) ABSTRACT

An inkjet printer 1 has an elastic ink pack 10 that holds ink, and an ink supply mechanism 5 that pressurizes the ink pack 10 and supplies ink to the ink path 4 side. The ink supply mechanism 5 has a pressure pump 15; a remaining ink monitor 52 that watches if the ink in the ink pack 10 has dropped to a specific remaining ink level; a first pressure control unit 56 that drives the pressure pump 15 until the pump pressure reaches a preset first set pressure P1 when the remaining ink has not reached the specific remaining ink level; and a second pressure control unit 57 that drives the pressure pump 15 until the pump pressure reaches a second set pressure P2 that is higher than the first set pressure P1 when the remaining ink has reached the specific remaining ink level.

10 Claims, 6 Drawing Sheets

INK SUPPLY CONTROL METHOD FOR AN INKJET PRINTER, AND AN INKJET PRINTER

BACKGROUND

1. Technical Field

The present disclosure relates to an ink supply control method of an inkjet printer that pressurizes an elastic ink pack with a pressure pump and supplies ink from the ink pack to an ink path that communicates with an inkjet head, and to an inkjet printer.

The present application is a continuation application of U.S. patent application Ser. No. 14/051,961, filed on Oct. 11, 2013, which is scheduled to issue on May 19, 2015 as U.S. Pat. No. 9,033,475. The present application claims priority based on and incorporates by reference the entire contents of Japan Patent Application No. 2012-225748 filed in Japan on 2012 Oct. 11,and Japan Patent Application No. 2012-226677 filed on 2012 Oct. 12.

2. Related Art

An inkjet printer according to the related art is described in Japanese Unexamined Patent Appl. Pub. JP-A-2009-190410. An ink cartridge used in the inkjet printer disclosed in JP-A-2009-190410 has an elastic ink pack that holds ink, a rigid case that holds the ink pack, and a pressure chamber formed between the case and the ink pack. The inkjet printer applies pressure to the ink pack by feeding air into the pressure chamber by means of a pressure pump, and pressure feeds ink from the ink pack into the ink path.

The pressure pump used in JP-A-2009-190410 has a pressure sensor for detecting the pump pressure. The pressure sensor has an intake chamber to which air fed from the pump unit to the pressure chamber is introduced, a diaphragm that is a wall of the intake chamber and is displaced by the pressure inside the intake chamber, and an optical sensor unit that detects displacement of the diaphragm. When the diaphragm is detected by the optical sensor unit to have displaced to a position pushed to the outside of the intake chamber, the pressure sensor detects that the pressure of the pressure pump is at a first pressure sufficient to pump ink through the ink path. When the diaphragm is detected by the optical sensor unit to have displaced to a position collapsed to the inside of the intake chamber, the pressure sensor detects that the pressure of the pressure pump is at a second pressure, which is lower than the first pressure.

The pressure of the pressure pump drops over time. The pressure of the pressure pump also drops with consumption of ink by the inkjet head, that is, as the amount of ink in the ink pack decreases. Because ink in the ink pack cannot be supplied to the ink path when the pressure of the pressure pump drops enough, the inkjet printer disclosed in JP-A-2009-190410 drives the pressure pump and pumps air into the pressure chamber when the pressure of the pressure pump is detected to have dropped to the second pressure.

The pressure applied to the ink pack to feed ink into the ink path (that is, the pressure of the pressure pump) is set so that the first pressure, which is the sum of the ink meniscus pressure formed in an ink nozzle of the inkjet head and the pressure of the pressure pump, is greater than the second pressure, which is the sum of the potential head of the ink pack, the back pressure of the ink pack, and the dynamic pressure of the ink path.

The back pressure of the ink pack rises rapidly when little ink is left in the ink pack. Therefore, when the pressure pump is set to a low pressure, ink inside the ink pack cannot be sufficiently pumped into the ink path, and the amount of ink left in the ink pack instead of being pumped into the ink path increases. However, if the pressure pump is set to a high pressure, the amount of residual ink can be decreased but the service life of the pressure pump is shortened because the drive time of the pressure pump is increased.

When print data is not supplied to the inkjet printer from an external device for a certain period of time, control may go to a power conservation mode that stops supplying power to the motors and sensors and provides power only to the CPU or other control unit. If the pressure of the pressure pump is managed based only on output from the pressure sensor in this type of inkjet printer, the pressure of the pressure pump cannot be determined while in the power conservation mode. For example, if operation continues in the power conservation mode for an extended time, the pressure of the pressure pump may drop below the second pressure over time. However, because there is no output from the pressure sensor while in the power conservation mode, the control unit cannot determine the pressure in the pressure pump. Because driving the pressure pump cannot be controlled based on output from the pressure sensor, keeping the pressure of the pressure pump above the second pressure level during the power conservation mode is difficult.

If print data is supplied from an external device while the inkjet printer is in the power conservation mode, the inkjet printer must exit the standby mode and resume the normal operating mode. Once the normal operating mode is resumed, the inkjet printer drives the pressure pump until the first pressure is reached so that ink can be pumped from the ink pack into the ink path, and then starts printing the print data. If the pressure of the pressure pump is significantly below the second pressure at this time, the pressure pump must be driven a long time to reach the first pressure, and the delay between receiving the print data and starting to print the print data increases.

SUMMARY

The present disclosure provides an ink supply control method for an inkjet printer and an inkjet printer that can reduce the amount of unused ink left in the ink pack while suppressing shortening the service life of the pressure pump.

An ink supply control method for an inkjet printer and an inkjet printer according to another aspect of the disclosure can determine the pressure of the pressure pump without using the output from the pressure sensor, shorten the drive time required for the pressure pump to rise to the pressure required to pump ink, and thereby shorten the time from receiving print data to starting to print the print data and avoid delaying the start of printing.

One aspect of the disclosure is an ink supply control method of an inkjet printer that pressurizes an elastic ink pack containing ink with a pressure pump and supplies the ink to an ink path communicating with an inkjet head, the control method including steps of: monitoring if the remaining ink in the ink pack reached a specific remaining ink level that is less than or equal to a preset residual level; driving the pressure pump until the pressure reaches a preset first set pressure when reaching the specific remaining ink level is not detected; and driving the pressure pump until the pressure reaches a preset second set pressure that is higher than the first set pressure when reaching the specific remaining ink level is detected.

When the amount of ink remaining in the ink pack decreases to a specific remaining ink level (threshold) and the back pressure of the ink pack rises, this method of the disclosure raises the pressure of the pressure pump from a first set pressure to a second set pressure. Ink in the ink pack can therefore be pumped to the ink path side despite the rise in back pressure on the ink pack. The amount of ink left in the ink pack can therefore be reduced without feeding ink into the ink path. Because the pressure pump is also driven at a high pressure level only after the remaining ink in the ink pack drops to a specific remaining ink level, driving the pressure pump for a long time can be prevented and shortening the service life of the pressure pump can be prevented.

In an ink supply control method of an inkjet printer according to another aspect of the disclosure, the pressure pump has a regulator; and the following condition (1) is satisfied $$P2>SP-\alpha \quad (1)$$

where the second set pressure of the pressure pump is P2, the set operating pressure at which the regulator of the pressure pump operates is SP, and the pressure range in which operation of the regulator deviates from the set operating pressure is $\pm\alpha$.

The maximum pressure of a pressure pump with a regulator is generally set in a range where the regulator does not operate. More specifically, the deviation range of regulator operation (the range of pressure deviation to the set operating pressure) is considered when setting the pressure of the pressure pump, and the set pressure is the difference of the desired pressure minus this deviation range. However, because operation of the regulator does not affect the ink supply operation with this method, the second set pressure of the pressure pump can be set to satisfy equation (1) without considering deviation in regulator operation. The amount of remaining ink can therefore be minimized because the second set pressure is higher than when deviation in regulator operation is considered.

In an ink supply control method of an inkjet printer according to another aspect of the disclosure, the following condition (2) is satisfied $$P2-\beta>SP-< \quad (2)$$

where the pressure range in which the operation of the pressure pump deviates from the target pressure is $\pm\beta$.

The upper pressure limit of a pressure pump with regulator is generally set with consideration for the deviation range of pressure pump operation (the pressure range in which the pressure of the pressure pump deviates from the set pressure) so that the regulator does not operate. More specifically, when setting the pressure of the pressure pump, the difference of the desired pressure minus this deviation range is set as the set pressure.

However, because operation of the regulator does not affect the ink supply operation with this method, the second set pressure of the pressure pump can be set to satisfy equation (2) without considering the deviation range of pressure pump operation. The amount of residual ink left in the ink pack can therefore be minimized because the second set pressure is higher than when the deviation range of pressure pump operation is considered.

An ink supply control method of an inkjet printer according to another aspect of the disclosure, also has steps of: previously driving the pressure pump until the pressure reaches the second set pressure, then stopping the pressure pump, and measuring the pressure of the pressure pump, which decreases over time after the pressure pump stops, and storing the actual pressure measurements as change-in-pressure information relating the change in the pressure of the pressure pump to the elapsed time; executing a pressurization operation that drives the pressure pump until the pressure of the pressure pump reaches the second set pressure when the specific remaining ink level is detected, and then stops the pressure pump; measuring the elapsed time from the pressurization end time when the pressure pump stopped, and determining ink use by the inkjet head from the pressurization end time; and calculating the pressure of the pressure pump since the pressurization end time as an estimated pressure at a specific interval based on the change-in-pressure information, the pressurization operation, the elapsed time, and the ink use.

The method according to this aspect of the disclosure enables knowing the pressure of the pressure pump after the pressurization end time without using a pressure sensor.

An ink supply control method of an inkjet printer according to another aspect of the disclosure also includes a step of executing a second pressurization operation that drives the pressure pump until the estimated pressure reaches the second set pressure when the estimated pressure goes to or below a minimum pressure that is higher than the first set pressure and lower than the second set pressure.

This aspect of the disclosure can hold the pressure of the pressure pump high.

Another aspect of the disclosure is an ink supply control method of an inkjet printer that pressurizes an elastic ink pack containing ink with a pressure pump and supplies the ink to an ink path communicating with an inkjet head, the control method including steps of: executing a pressurization operation that drives the pressure pump until the pressure of the pressure pump reaches a predetermined set pressure; stopping the pressure pump; measuring the elapsed time from the pressurization end time when the pressure pump stopped, and determining ink use by the inkjet head since the pressurization end time; calculating the pressure of the pressure pump since the pressurization end time at a specific interval as an estimated pressure based on the pressurization operation, the elapsed time, and the ink use; and driving the pressure pump until the estimated pressure reaches the set pressure when the estimated pressure goes to or below a minimum pressure that is lower than the set pressure.

This method of the disclosure enables knowing the pressure of the pressure pump as an estimated pressure value that is calculated from the pressurization operation of the pressure pump, the time past from the pressurization end time when the pressurization operation stopped, and ink use by the inkjet head. The pressure of the pressure pump can therefore be managed without using output from a pressure sensor. The pressure pump can therefore be controlled and driven based on the pressure of the pressure pump (estimated pressure) even when operating in a power conservation mode in which the inkjet printer does not supply power to a pressure sensor. Because the pressure pump is driven and the pressure is increased when the estimated pressure goes to a minimum pressure, the pressure of the pressure pump can be prevented from going below the minimum pressure. The drive time of the pressure pump required to raise the pressure of the pressure pump from the minimum pressure level to the set pressure can therefore be adjusted by adjusting the minimum pressure. As a result, delaying the time from receiving print data to starting to print the print data due to the drive time required to increase the pressure of the pressure pump to the pressure required to pressure feed the ink can be suppressed or prevented.

The ink supply control method of an inkjet printer according to another aspect of the disclosure also has steps of: measuring the actual pressure of the pressure pump, which decreases from when the pressure pump stops; storing the actual pressure measurements as change-in-pressure information relating the change in the pressure of the pressure pump to the time elapsed from when the pressure pump stopped; and calculating the estimated pressure based on the change-in-pressure information, the elapsed time, the ink use, and the pressurization operation of the pressure pump after the pressurization end time.

This aspect of the disclosure enables calculating the estimated pressure accurately.

In the ink supply control method of an inkjet printer according to another aspect of the disclosure, the drive time for which the pressure pump is driven until the estimated pressure reaches the set pressure is shorter than the printing preparation time required for the inkjet head to start printing the print data after the print data is received.

This aspect of the disclosure enables starting to print the print data without delay when print data is received.

The ink supply control method of an inkjet printer according to another aspect of the disclosure also has a step of: driving the pressure pump until the estimated pressure reaches the set pressure if the estimated pressure is at a reference pressure that is lower than the set pressure and higher than the minimum pressure when the print data is received from an external device.

This aspect of the disclosure prevents the pressure of the pressure pump from dropping drastically while printing print data.

The ink supply control method of an inkjet printer according to another aspect of the disclosure preferably also has steps of: detecting if the remaining ink in the ink pack has reached a specific remaining ink level that is less than or equal to a preset remaining ink level; setting the set pressure as a first pressure and the minimum pressure as a second pressure that is lower than the first pressure if the remaining ink in the ink pack has not reached the specific remaining ink level; and setting the minimum pressure to a third pressure that is higher than the first pressure, and setting the set pressure to a fourth pressure that is higher than the third pressure, if the remaining ink in the ink pack has reached the specific remaining ink level.

Because the back pressure of the ink pack rises sharply when the remaining ink in the ink pack is low, ink inside the ink pack cannot be sufficiently fed into the ink path when the pressure of the pressure pump remains constant, and the amount of ink left in the ink pack without being fed into the ink path increases.

When the amount of ink remaining in the ink pack decreases to a specific remaining ink level and the back pressure of the ink pack rises, this method of the disclosure raises the pressure of the pressure pump that pressurizes the ink pack from a first pressure to a second pressure. Ink in the ink pack can therefore be pumped to the ink path side despite the rise in back pressure on the ink pack. The amount of ink left in the ink pack can therefore be reduced. Because the pressure pump is also driven at a high pressure level only after the remaining ink in the ink pack drops to a specific remaining ink level, driving the pressure pump for a long time can be prevented and shortening the service life of the pressure pump can be prevented.

Another aspect of the disclosure is an inkjet printer having an elastic ink pack containing ink, and a pressure pump that pressurizes the ink pack and supplies the ink to an ink path communicating with an inkjet head, the inkjet printer including: a remaining ink monitor that monitors if the remaining ink in the ink pack reached a specific remaining ink level that is less than or equal to a preset residual level; a first pressure control unit that drives the pressure pump until the pressure reaches a preset first set pressure when reaching the specific remaining ink level is not detected; and a second pressure control unit that drives the pressure pump until the pressure reaches a preset second set pressure that is higher than the first set pressure when reaching the specific remaining ink level is detected.

When the amount of ink remaining in the ink pack decreases to a specific remaining ink level and the back pressure of the ink pack rises in this aspect of the disclosure, control of the pressure pump moves from the first pressure control unit to the second pressure control unit, and the pressure of the pressure pump is increased from a first set pressure to a second set pressure. Ink in the ink pack can therefore be pumped to the ink path side despite the rise in back pressure on the ink pack. The amount of ink left in the ink pack can therefore be reduced without feeding ink into the ink path. Because the second pressure control unit drives the pressure pump at a high pressure level only after the remaining ink in the ink pack drops to a specific remaining ink level, driving the pressure pump for a long time can be prevented and shortening the service life of the pressure pump can be prevented.

In an inkjet printer according to another aspect of the disclosure, the pressure pump has a regulator; and the following condition (1)

$$P2>SP-\alpha \quad (1)$$

is satisfied where the second set pressure of the pressure pump is P2, the set operating pressure at which the regulator of the pressure pump operates is SP, and the pressure range in which operation of the regulator deviates from the set operating pressure is $\pm\alpha$.

This aspect of the disclosure can minimize the amount of remaining ink because the second set pressure is higher than when deviation in regulator operation is considered.

In an inkjet printer according to another aspect of the disclosure, the following condition (2)

$$P2-\beta>SP-< \quad (2)$$

is satisfied where the pressure range in which the operation of the pressure pump deviates from the target pressure is $\pm\beta$.

The amount of residual ink left in the ink pack can therefore be minimized because the second set pressure is higher than when the deviation range of pressure pump operation is considered.

The inkjet printer according to another aspect of the disclosure preferably also has a storage unit that stores change-in-pressure information obtained by driving the pressure pump until the pump pressure goes to the second set pressure, stopping the pressure pump, and measuring the actual pressure of the pressure pump, which decreases from when the pressure pump stops, and storing the actual pressure measurements as change-in-pressure information relating the change in the pressure of the pressure pump to the elapsed time. The second pressure control unit includes an initial pressurization unit that, when reaching the specific remaining ink level is detected, executes a pressurization operation to drive the pressure pump until the pressure of the pressure pump reaches the second set pressure and then stops the pressure pump, a counter that measures the elapsed time from the pressurization end time when the pressure pump stopped; an ink usage counter that determines ink use by the inkjet head from the pressurization end time; and a pressure estimating unit that calculates the pressure of the pressure pump since the pressurization end time as an estimated pressure at a specific interval based on the change-in-pressure information, the pressurization operation, the elapsed time, and the ink use.

This aspect of the disclosure enables knowing the pressure of the pressure pump after the pressurization end time without using a pressure sensor.

Further preferably in an inkjet printer according to another aspect of the disclosure, the second pressure control unit has an additional pressurization unit that executes an additional pressurization operation that drives the pressure pump when the estimated pressure goes to or below a minimum pressure that is higher than the first set pressure and lower than the second set pressure until the estimated pressure reaches the second set pressure.

This aspect of the disclosure can hold the pressure of the pressure pump high.

Another aspect of the disclosure is an inkjet printer having an elastic ink pack containing ink, and a pressure pump that pressurizes the ink pack and supplies the ink to an ink path communicating with an inkjet head, the inkjet printer including: a pressure control unit that executes a pressurization operation to drive the pressure pump until the pressure of the pressure pump reaches a predetermined set pressure, and then stops the pressure pump; a counter that measures the elapsed time from the pressurization end time when the pressure pump stopped; an ink usage counter that determines ink use by the inkjet head since the pressurization end time; a pressure estimating unit that calculates the pressure of the pressure pump since the pressurization end time at a specific interval as an estimated pressure based on the pressurization operation, the elapsed time, and the ink use; and an additional pressurization control unit that drives the pressure pump until the estimated pressure reaches a set pressure that is higher than the minimum pressure when the estimated pressure goes to or below a preset minimum pressure.

This aspect of the disclosure enables knowing the pressure of the pressure pump as an estimated pressure value that is calculated from the pressurization operation of the pressure pump, the time past from the pressurization end time when the pressurization operation stopped, and ink use by the inkjet head. The pressure control unit can therefore manage the pressure of the pressure pump without relying only on output from a pressure sensor. The pressure control unit can therefore control driving the pressure pump driven based on the pressure of the pressure pump (estimated pressure) even when operating in a power conservation mode in which the inkjet printer does not supply power to a pressure sensor. Furthermore, because the pressure control unit drives the pressure pump and increases the pump pressure when the estimated pressure goes to a minimum pressure setting, the pressure of the pressure pump can be prevented from going below the minimum pressure. The drive time of the pressure pump required to raise the pressure of the pressure pump from the minimum pressure level to the set pressure can therefore be adjusted by adjusting the minimum pressure. As a result, delaying the time from receiving print data to starting to print the print data due to the drive time required to increase the pressure of the pressure pump to the pressure required to pressure feed the ink can be suppressed or prevented.

The inkjet printer according to another aspect of the disclosure also has a storage unit that stores change-in-pressure information obtained by measuring the actual pressure of the pressure pump, which decreases from when the pressure pump stops, and storing the actual pressure measurements as change-in-pressure information relating the change in the pressure of the pressure pump to the elapsed time from when the pressure pump stopped. The pressure estimating unit calculates the estimated pressure based on the change-in-pressure information, the elapsed time, the ink use, and the pressurization operation of the pressure pump after the pressurization end time.

This aspect of the disclosure enables calculating the estimated pressure accurately.

In an inkjet printer according to another aspect of the disclosure, the drive time for which the additional pressurization control unit drives the pressure pump when the estimated pressure goes to the minimum pressure so that the estimated pressure rises to the set pressure is shorter than the printing preparation time required for the inkjet head to start printing the print data after the print data is received.

This aspect of the disclosure enables starting to print the print data without delay when print data is received.

An inkjet printer according to another aspect of the disclosure preferably also has a communication unit that receives print data from an external device; and a second additional pressurization control unit that drives the pressure pump until the estimated pressure reaches the set pressure if the estimated pressure is at a reference pressure that is lower than the set pressure and higher than the minimum pressure limit when the print data is received.

This aspect of the disclosure prevents the pressure of the pressure pump from dropping drastically while printing print data.

An inkjet printer according to another aspect of the disclosure preferably also has: a remaining ink monitor that detects if the remaining ink in the ink pack has reached a specific remaining ink level that is less than or equal to a preset remaining ink level; the pressure control unit including a first pressure control unit that sets the set pressure as a first pressure, and sets the minimum pressure as a second pressure that is lower than the first pressure, if the remaining ink in the ink pack has not reached the specific remaining ink level, and a second pressure control unit that sets the minimum pressure limit to a third pressure that is higher than the first pressure, and sets the set pressure to a fourth pressure that is higher than the third pressure, if the remaining ink in the ink pack has reached the specific remaining ink level.

When the amount of ink remaining in the ink pack decreases to a specific remaining ink level and the back pressure of the ink pack rises, this aspect of the disclosure raises the pressure of the pressure pump that pressurizes the ink pack from a first pressure to a second pressure. Ink in the ink pack can therefore be pumped to the ink path side despite the rise in back pressure on the ink pack. The amount of ink left in the ink pack can therefore be reduced. Because the pressure pump is also driven at a high pressure level only after the remaining ink in the ink pack drops to a specific remaining ink level, driving the pressure pump for a long time can be prevented and shortening the service life of the pressure pump can be prevented.

Effect of the Disclosure

The disclosure reduces the amount of ink left in the ink pack without being used for printing while preventing the drive time of the pressure pump from becoming long.

The disclosure enables knowing the pressure of the pressure pump as an estimated pressure value that is calculated from the pressurization operation of the pressure pump, the time past from the pressurization end time when the pressurization operation stopped, and ink use by the inkjet head. The pressure of the pressure pump can therefore be managed without using output from a pressure sensor. Because the pressure pump is driven and the pressure is increased when the estimated pressure goes to a minimum pressure setting, the pressure of the pressure pump can be prevented from going below the minimum pressure. The drive time of the pressure pump required to raise the pressure of the pressure pump from the minimum pressure level to the set pressure can therefore be adjusted by adjusting the minimum pressure. As a result, delaying the time from receiving print data to starting to print the print data due to the drive time required to increase the pressure of the pressure pump to the pressure required to pressure feed the ink can be suppressed or prevented.

Other objects and attainments together with a fuller understanding of the disclosure will become apparent and appreciated by referring to the following description and claims taken in conjunction with the accompanying drawings.

DESCRIPTION OF EMBODIMENTS

A preferred embodiment of the present disclosure is described below with reference to the accompanying figures. Note that the vertical and horizontal scale of parts and members shown in the accompanying figures may differ from the actual for convenience of description and illustration.

Ink Supply System of an Inkjet Printer

Figure 1:
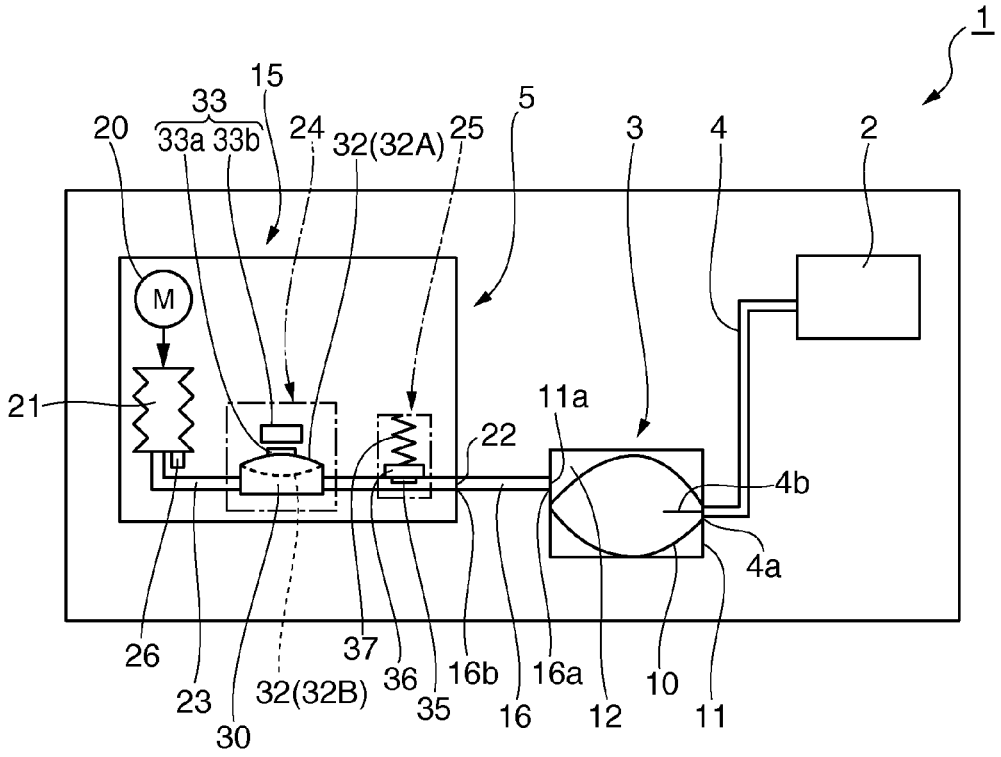
FIG. 1 describes the ink supply system of an inkjet printer according to the disclosure.
Figure 2:
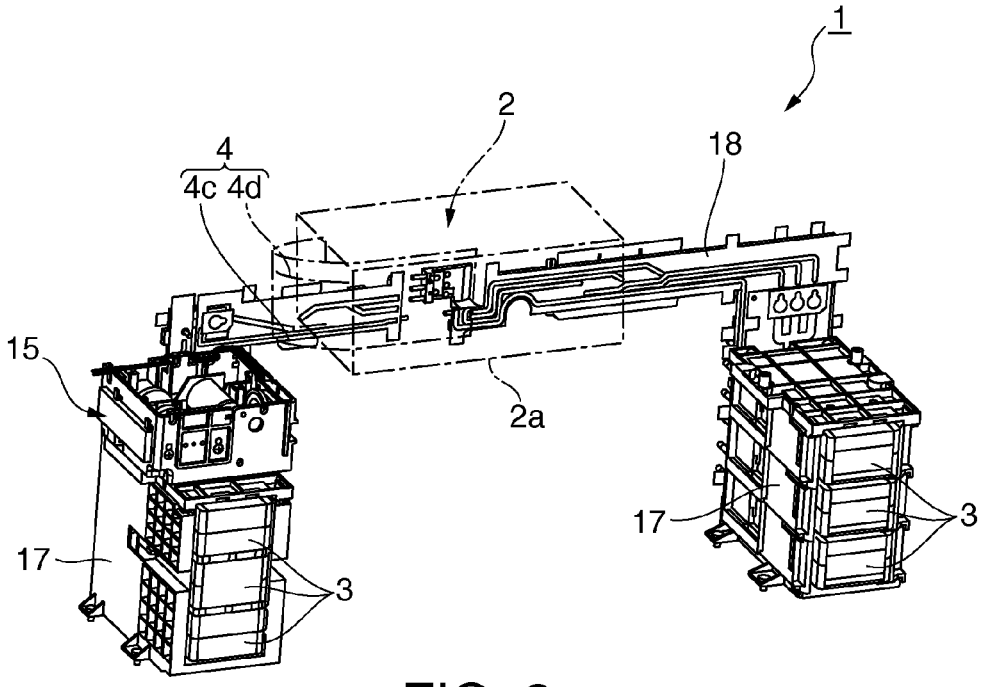
FIG. 2 is an oblique view showing main parts of the ink supply system.
Figure 3:
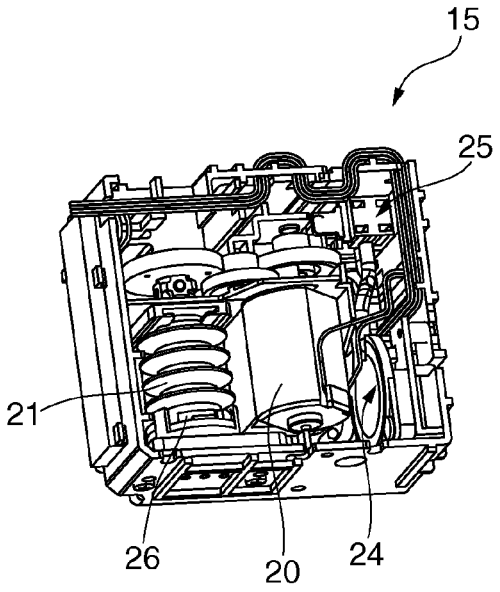
FIG. 3 is an oblique view of the pressure pump.

The ink supply system of an inkjet printer is described first with reference to FIG. 1 to FIG. 3. FIG. 1 describes the ink supply system of an inkjet printer according to this aspect of the disclosure. FIG. 2 is an oblique view showing main parts of the ink supply system. FIG. 3 is an oblique view of the pressure pump. When print data is supplied from an external device, the inkjet printer 1 conveys recording paper through a paper feed path past a printing position, and prints on the recording paper at the printing position using an inkjet head 2.

As shown in FIG. 1, the ink supply system of the inkjet printer 1 includes an ink cartridge 3 removably installed in the inkjet printer 1, and an ink supply mechanism 5 that supplies ink stored in the ink cartridge 3 through an ink path 4 to the inkjet head 2.

The ink cartridge 3 has a flexible ink pack 10 that stores ink, a rigid case 11 that holds the ink pack 10, and a pressure chamber 12 formed between the case 11 and ink pack 10.

The ink supply mechanism 5 includes a pressure pump 15, and an air pressure path 16 that connects the pressure pump 15 to the pressure chamber 12 of the ink pack 10. The ink supply mechanism 5 pumps air through the air pressure path 16 into the pressure chamber 12 by means of the pressure pump 15, pressurizing the ink pack 10 by means of the air pressure in the pressure chamber 12, and supplying ink from the ink pack 10 into the ink path 4.

When the ink cartridge 3 is installed to the cartridge holder 17 (FIG. 2) of the inkjet printer 1, the upstream end 4*a* of the ink path 4 (the end on the opposite side as the inkjet head 2) is removably connected to the ink pack 10. More specifically, a needle 4*b* is disposed to the upstream end 4*a* of the ink path 4, and when the ink cartridge 3 is installed to the cartridge holder 17, the needle 4*b* is inserted to the ink pack 10 through a needle port disposed in the case 11 and the ink pack 10, and ink in the ink pack 10 can flow out through the needle 4*b* into the ink path 4. In addition, when the ink cartridge 3 is installed to the cartridge holder 17, the downstream end 16*a* of the air pressure path 16 (the end of the air pressure path 16 on the opposite side as the pressure pump 15) is removably connected to the pressure chamber 12. More specifically, when the ink cartridge 3 is installed to the inkjet printer 1, the air inlet 11*a* of the pressure chamber 12 disposed in the case 11 communicates with an opening 35 in the downstream end 16*a* of the air pressure path 16.

As shown in FIG. 2, the inkjet printer 1 according to this embodiment of the disclosure has six ink cartridges 3 installed in the cartridge holder 17. The air pressure paths 16 connecting the pressure pump 15 and the six ink cartridges 3 are formed on a flat circuit board 18. The ink path 4 connecting the inkjet head 2 to each of the ink cartridges 3 has a first ink path portion 4*c* disposed to the circuit board 18, and a flexible second ink path portion 4*d* connecting the downstream end of the first ink path portion 4*c* to the inkjet head 2.

The ink cartridges 3 are disposed lower than the inkjet head 2 in the direction of gravity.

The inkjet head 2 is disposed with the nozzle face 2*a* of the ink nozzles facing down.

As shown in FIG. 3, the pressure pump 15 has a DC motor 20 as the power supply, a bellows pump 21 for pressurizing air, and an air supply port 22 from which air pressurized by the bellows pump 21 is ejected to the air pressure path 16 side. The air supply port 22 is connected to the upstream end 16*b* of the air pressure path 16, and the air supply port 22 communicates with the pressure chamber 12 of the ink cartridge 3 through the air pressure path 16.

The pressure pump 15 also has a regulator 25 and a pressure sensor 24 for detecting the pump pressure disposed to the internal air path 23 (see FIG. 1). The pressure sensor 24 and regulator 25 are disposed to the internal air path 23 with the regulator 25 on the downstream side of the pressure sensor 24 in the direction of air flow. The pressure pump 15 also has a pump sensor 26 for detecting the number of times the bellows pump 21 completes the pressurization operation ("pressurization count" below), that is, how many times the bellows pump 21 compresses. The pump sensor 26 could be a switch that operates each time the bellows pump 21 compresses, for example.

As shown in FIG. 1, the pressure sensor 24 has an air inlet chamber 30 through which air that is pressure fed from the bellows pump 21 to the pressure chamber 12 is introduced, a diaphragm 32 that is one wall of the air inlet chamber 30 and displaces according to the pressure in the air inlet chamber 30, and an optical sensor unit 33 that detects displacement of the diaphragm 32.

The diaphragm 32 can change between an outside position 32A at which the diaphragm 32 inflates away from the bottom 30*a* of the air inlet chamber 30 opposite the diaphragm 32 and increases the volume of the air inlet chamber 30; and an inside position 32B where the diaphragm 32 collapses toward the bottom 30*a* of the air inlet chamber 30 and reduces the volume of the air inlet chamber 30. The optical sensor unit 33 detects whether the diaphragm 32 is inflated to the outside position 32A, or deflated to the inside position 32B. When the optical sensor unit 33 detects that the diaphragm 32 is in the outside (inflated) position 32A, the pressure sensor 24 outputs a first signal indicating that the pressure produced by the bellows pump 21 (the pressure of the pressure pump 15) has reached a first set pressure (first pressure) P1. When the optical sensor unit 33 detects the diaphragm 32 at the inside (deflated) position 32B, the pressure sensor 24 outputs a second signal indicating that the pressure produced by the bellows pump 21 (the pressure of the pressure pump 15) has gone to or below a predetermined first reference pressure (second pressure) Q1. The first reference pressure Q1 is lower than the first set pressure P1.

The optical sensor unit 33 could have a reflector 33*a* disposed to the outside surface of the diaphragm 32, and a reflective photosensor 33*b* disposed at a position opposite the reflector 33*a*. In this configuration, the reflective photosensor 33*b* emits a detection beam toward the reflector 33*a*, and receives the reflection of the detection beam from the reflector 33*a*. The pressure sensor 24 detects the position (displacement) of the diaphragm 32 by determining the distance between the reflective photosensor 33*b* and the reflector 33*a* based on output from the reflective photosensor 33*b*.

The regulator 25 includes an opening 35 in a side wall part of the internal air path 23, a closing member 36 that closes the opening 35 to the outside of the air path, and an urging member 37 such as a coil spring that urges the closing member 36 in the direction closing the opening 35 with a specific urging force.

The regulator 25 operates when the pressure produced by the bellows pump 21 (the pressure of the pressure pump 15) equals or exceeds the set operating pressure of the regulator 25, and lowers the pressure. More specifically, when the pressure produced by the bellows pump 21 equals or exceeds the set operating pressure, the closing member 36 moves in the direction opening the opening 35 in resistance to the urging force of the urging member 37, releasing air from the opening 35 and lowering the pressure of the pressure pump 15. When the pressure from the bellows pump 21 then goes below the set operating pressure, the closing member 36 returns in the direction closing the opening 35 due to the urging force of the urging member 37, and closes the opening 35.

Figure 4:
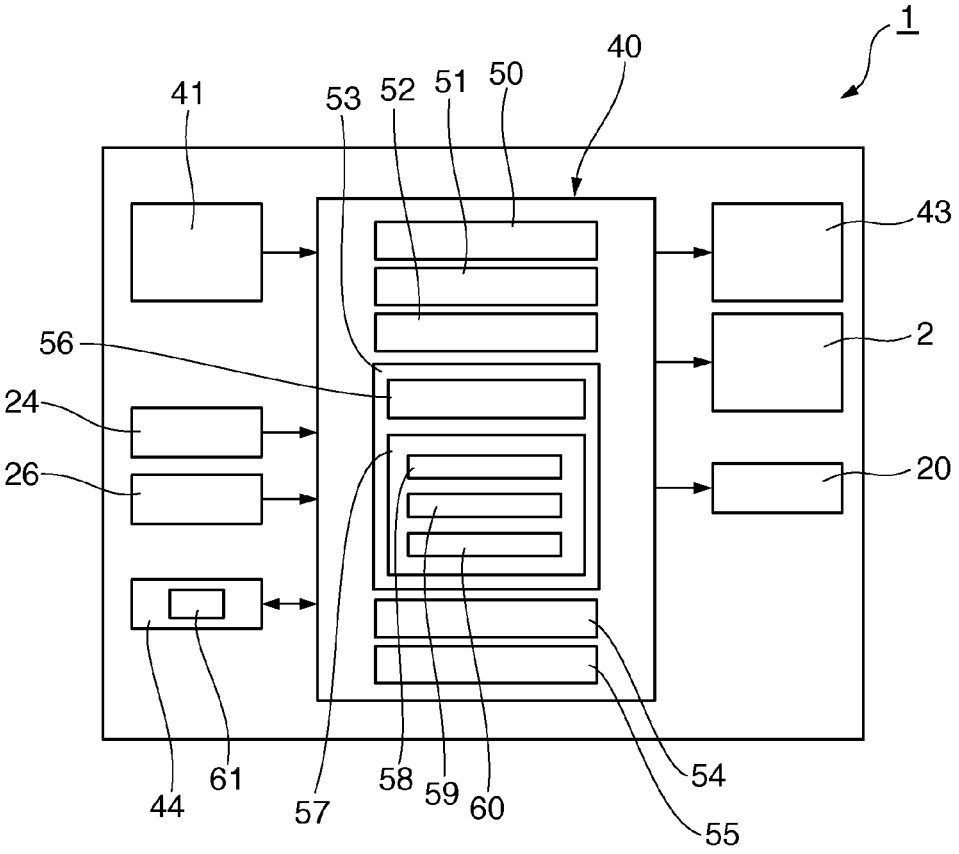
FIG. 4 is a block diagram of the inkjet printer control system.
Figure 5:
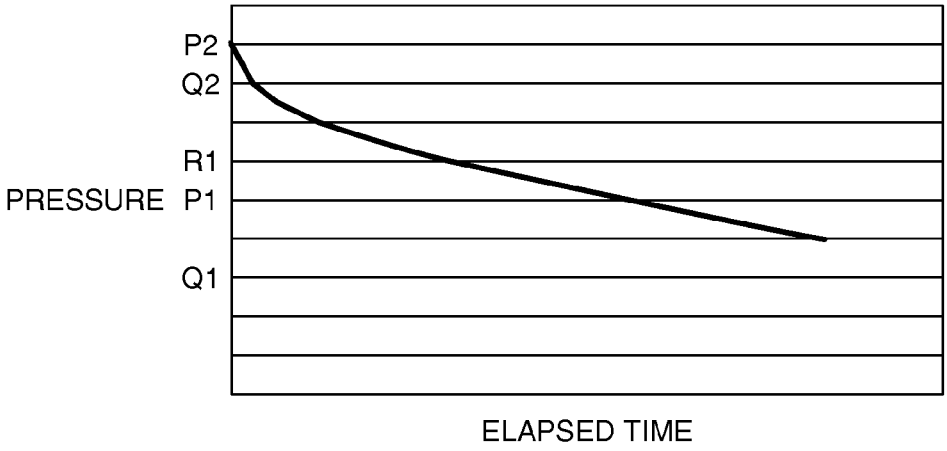
FIG. 5 is a graph showing pressure change over time.

The inkjet printer control system is described next with reference to FIG. 4 and FIG. 5. FIG. 4 is a basic block diagram showing the control system of the inkjet printer 1. FIG. 5 is a graph showing pressure change information (more specifically, the change in pressure over time).

As shown in FIG. 4, the inkjet printer 1 is built around a control unit 40 that includes a CPU. A communication unit 41 with a communication interface, the pressure sensor 24 of the pressure pump 15, and the pump sensor 26 are connected to the input side of the control unit 40. A paper feed motor 43 for conveying the recording paper, the inkjet head 2, and the DC motor 20 of the pressure pump 15, are connected through drivers not shown to the output side of the control unit 40. Memory (storage unit) 44 is also connected to the control unit 40. The communication unit 41 receives print data from an external device.

The control unit 40 includes a print control unit 50 that controls the printing operation to print the received print data, an ink usage counter 51 that determines the amount of ink used by the inkjet head 2, a remaining ink calculator (remaining ink monitor) 52 that determines how much ink is left in the ink pack 10, a pressure control unit 53 that controls driving the pressure pump 15, a counter 54 including a timer, and a pressure estimating unit 55 that estimates the pressure of the pressure pump 15. The counter 54 measures the elapsed time from the pressurization end time when the pressure pump 15 stops.

When the communication unit 41 receives print data, the print control unit 50 drives the paper feed motor 43 to index the recording paper to the printing position. The print control unit 50 then monitors pressurization by the pressure pump 15, and when the pressure pump 15 has reached a reference pressure, controls driving the paper feed motor 43 and inkjet head 2 and starts printing the print data. The reference pressure of the pressure pump 15 is set so that a first pressure, which is the sum of the ink meniscus pressure formed in an ink nozzle of the inkjet head 2 and the reference pressure, is greater than a second pressure, which is the sum of the potential head of the ink pack, the back pressure of the ink pack, and the dynamic pressure of the ink path 4.

The ink usage counter 51 counts the number of shots of ink droplets ejected from the inkjet head 2, and calculates ink use by the inkjet head 2 based on this shot count.

The remaining ink calculator 52 (remaining ink monitor) calculates how much ink remains in the ink pack by subtracting the ink used by the inkjet head 2 from the rated volume of ink in the ink pack 10. The remaining ink calculator 52 also monitors whether or not the remaining ink volume has gone to a specific remaining ink level (threshold), which is a predetermined amount of residual ink. The remaining ink in the ink pack is near zero when this specific remaining ink level is reached.

The pressure control unit 53 has a first pressure control unit 56 that controls driving the pressure pump 15 until the remaining ink calculator 52 detects that the remaining ink in the ink pack 10 reached the specific remaining ink level; and a second pressure control unit 57 that controls driving the pressure pump 15 after the remaining ink calculator 52 detects that the specific remaining ink level was reached.

When the communication unit 41 has received print data and the pressure sensor 24 outputs a second signal, the first pressure control unit 56 drives the pressure pump 15 until the pressure sensor 24 outputs a first signal, and then stops the pressure pump 15. More specifically, if the pressure of the pressure pump 15 is less than or equal to first reference pressure Q1 at the time print data is received, the first pressure control unit 56 drives the pressure pump 15 to increase the pressure to first set pressure P1.

While the residual ink in the ink pack 10 is not detected to have reached the specific remaining ink level (while the pressure pump 15 is driven by the first pressure control unit 56), the print control unit 50 uses the first reference pressure Q1 as the reference pressure on which starting to print is based. Therefore, when the pressure pump 15 is driven after the communication unit 41 receives print data, and the pump pressure rises to first set pressure P1 , the print control unit 50 starts printing the print data.

The second pressure control unit 57 includes an initial pressurization unit 58, first additional pressurization unit 59, and second additional pressurization unit 60.

When the remaining ink calculator 52 detects that the specific remaining ink level was reached, the initial pressurization unit 58 executes an initial pressurization operation that drives the pressure pump 15 to pressurize to the second set pressure P2 (fourth pressure), and then stops the pressure pump 15. This second set pressure P2 is higher than the first set pressure P1.

More specifically, when the remaining ink calculator 52 detects that the specific remaining ink level was reached and the pressure sensor 24 outputs the first signal, the initial pressurization unit 58 drives the bellows pump 21 a predetermined specific number of times so that the pressure of the pressure pump 15 rises to the second set pressure P2.

When the remaining ink calculator 52 detects that the specific remaining ink level was reached and the pressure sensor 24 does not output the first signal, the initial pressurization unit 58 drives the bellows pump 21 until the first signal is output from the pressure sensor 24, then drives the bellows pump 21 the predetermined specific number of times so that the pressure of the pressure pump 15 rises to the second set pressure P2.

Note that the inkjet printer 1 according to this embodiment of the disclosure does not have a sensor that detects when the pressure of the pressure pump 15 reaches the second set pressure P2. The initial pressurization unit 58 therefore determines that the pressure of the pressure pump 15 reached the second set pressure P2 by operating the bellows pump 21 a specific number of times after the first signal is output from the pressure sensor 24.

When the estimated pressure calculated by the pressure estimating unit 55 goes to or below a minimum pressure (third pressure) R1 that is lower than the first set pressure P1 , the first additional pressurization unit 59 executes a first additional pressurization operation that drives the pressure pump 15 to raise the estimated pressure to the second set pressure P2. Note that the minimum pressure R1 is higher than the first set pressure P1. The minimum pressure R1 is also set so that the drive time t (see FIG. 8) required to drive the pressure pump 15 to reach the second set pressure P2 after the estimated pressure drops to the minimum pressure R1 is shorter than the printing preparation time required for the inkjet head 2 to start printing the print data after the print data is received. The printing preparation time is the time from when the communication unit 41 receives print data from an external device until indexing the recording paper to the printing position is completed.

If the estimated pressure calculated by the pressure estimating unit 55 at the time the print data is received is less than second set pressure P2, and is less than or equal to second reference pressure Q2, which is higher than minimum pressure R1, the second additional pressurization unit 60 executes a second additional pressurization operation that drives the pressure pump 15 and increases the estimated pressure to the second set pressure P2.

When the amount of ink left in the ink pack 10 is detected to have reached the specific remaining ink level (when the second pressure control unit 57 controls driving the pressure pump 15), the print control unit 50 sets the second reference pressure Q2 as the reference pressure used as a basis for starting to print. The print control unit 50 therefore starts printing the print data when the pressure pump 15 is driven after the communication unit 41 receives print data and the estimated pressure rises to the second set pressure P2, which is greater than the second reference pressure Q2.

The pressure estimating unit 55 calculates the pressure of the pressure pump 15 at a regular interval based on change-in-pressure information 61 stored in the memory 44, the amount of ink used after the pressure pump 15 stops pressurizing, and the pressurization operation of the pressure pump 15 (initial pressurization, first additional pressurization, second additional pressurization operations).

The change-in-pressure information 61 relates the actually measured pressure of the pressure pump 15, which drops from the time the pressure pump 15 stops after the pressure pump 15 is driven to reach the second set pressure P2 and the pressure pump 15 is then stopped, to the change in the pressure of the pressure pump 15 and the time past from when the pressure pump 15 stopped operating. The change-in-pressure information 61 appears as shown in FIG. 5 when plotted on a graph. In this embodiment, the elapsed time and the change in the pressure of the pressure pump 15 (the slope of the line) are stored as a lookup table in memory 44.

The ink use after pressure pump 15 stops pressurizing is the amount of ink used by the inkjet head 2 after the pressure pump 15 raises the estimated pressure to the second set pressure P2 and then stops. Each time the pressure pump 15 stops after boosting the estimated pressure to the second set pressure P2, the ink usage counter 51 calculates the estimated ink use again, and the pressure estimating unit 55 can reference the value acquired by the ink usage counter 51.

The pressurization operation of the pressure pump 15 refers to the number of times the bellows pump 21 is driven (compressed) during each of the initial pressurization, first additional pressurization, and second additional pressurization operations, and the pressure estimating unit 55 gets this pressurization operation count based on the output from the pump sensor 26.

The second set pressure P2 of the pressure pump 15 is set to satisfy conditions (1) and (2) below where the set operating pressure at which the regulator 25 of the pressure pump 15 operates is SP; the pressure range in which operation of the regulator 25 deviates from the set operating pressure is $\pm\alpha$; and the pressure range in which the pressure of the pressure pump 15 deviates from the set pressure is $\pm\beta$.

$$P2>SP-\alpha \quad (1)$$

$$P2-\beta>SP-< \quad (2)$$

In general, the upper pressure limit of the pressure pump 15 with the regulator 25 is set in a range that does not cause the regulator 25 to operate. More specifically, when setting the pressure of the pressure pump 15, the deviation range of regulator 25 operation (the pressure range in which regulator 25 operation deviates from the set operating pressure) is considered by using the difference of the desired pressure minus this range of deviation as the pressure setting (set pressure).

However, because operation of the regulator 25 does not affect the ink supply operation in this embodiment, the second set pressure P2 of the pressure pump 15 is set to satisfy equation (1) without considering deviation in regulator 25 operation. As a result, the second set pressure P2 is higher than when deviation in regulator 25 operation is considered. The inkpack 10 can therefore be urged with higher pressure than when deviation in regulator 25 operation is considered.

The upper pressure limit of a pressure pump 15 with regulator 25 is also generally set with consideration for the deviation range of pressure pump 15 operation (the pressure range in which the pressure of the pressure pump 15 deviates from the set pressure) so that the regulator 25 does not operate. More specifically, when setting the pressure of the pressure pump 15, the difference of the desired pressure minus this deviation range is set as the set pressure.

However, because operation of the regulator 25 does not affect the ink supply operation in this embodiment, the second set pressure P2 of the pressure pump 15 is set to satisfy equation (2) without considering the deviation range of pressure pump 15 operation. As a result, the second set pressure P2 is higher than when the deviation range of pressure pump 15 operation is considered. The ink pack 10 can therefore be urged with higher pressure than when the deviation range of pressure pump 15 operation is considered. By urging the ink pack 10 with high pressure, the amount of residual ink left in the ink pack 10 can be reduced without pushing the ink into the ink path 4

Ink Supply Control Operation

Figure 6:
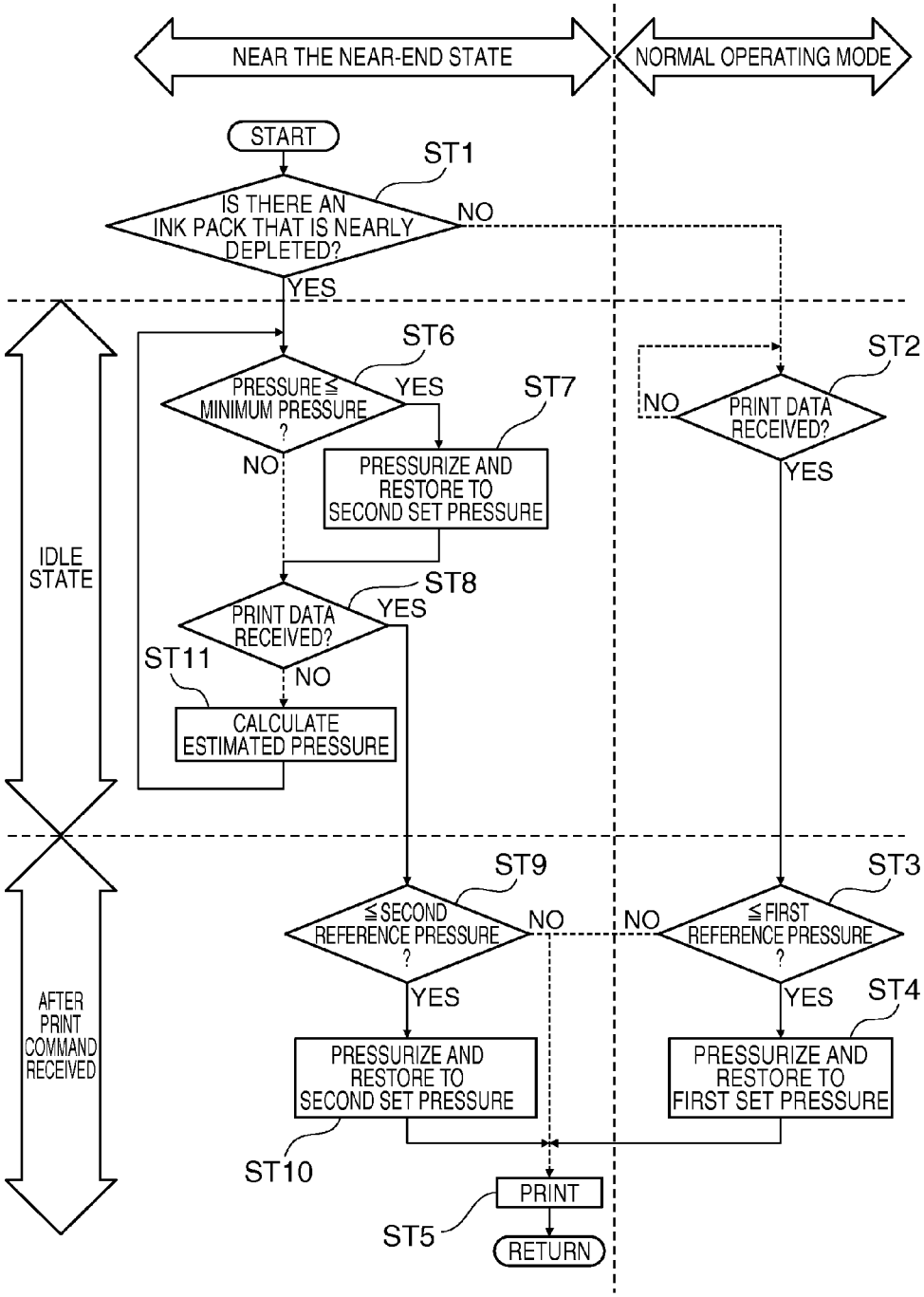
FIG. 6 is a flow chart of the ink supply operation.
Figure 7:
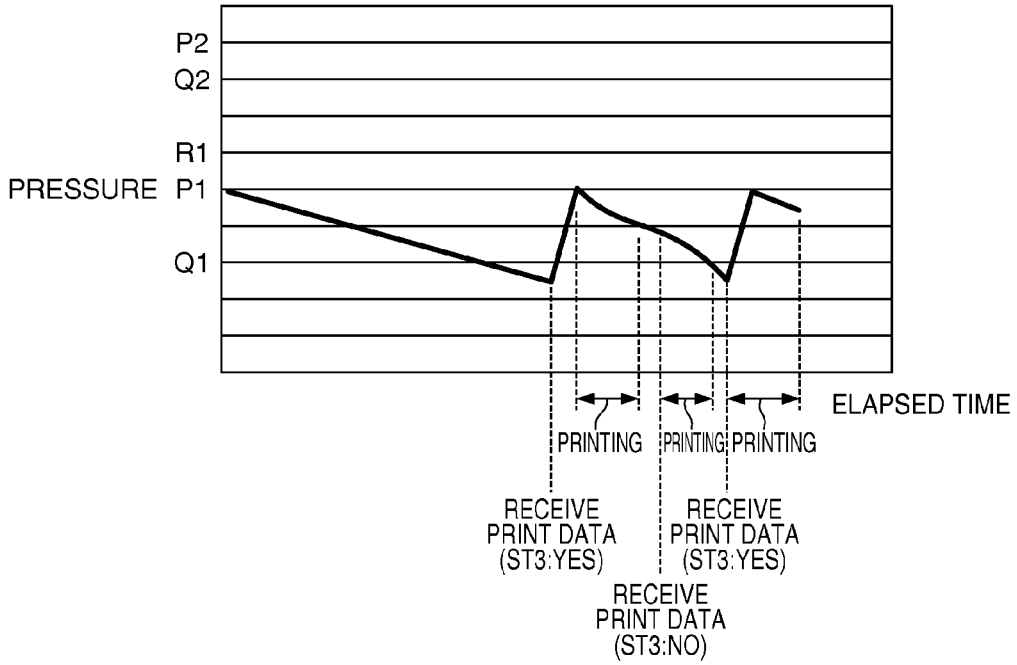
FIG. 7 is a graph showing change in the pressure of the pressure pump during the ink supply control operation.
Figure 8:
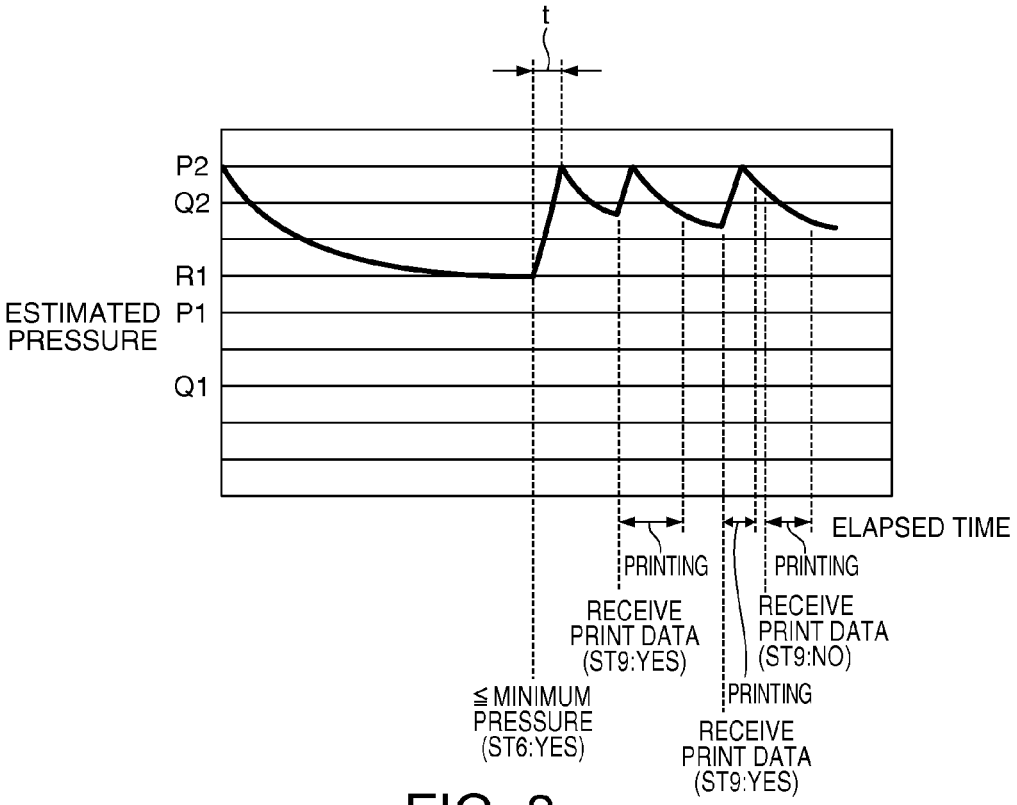
FIG. 8 is a graph showing change in the pressure of the pressure pump during the ink supply control operation.

The ink supply control operation of the disclosure is described next with reference to FIG. 6 to FIG. 8. FIG. 6 is a flow chart of the ink supply control operation. FIG. 7 is a graph showing change in the pressure of the pressure pump during the ink supply operation when the specific remaining ink level is not detected. FIG. 8 is a graph showing change in the pressure of the pressure pump during the ink supply operation when the specific remaining ink level is detected.

As shown in FIG. 6, when the inkjet printer 1 operates, the remaining ink calculator 52 determines if there is an ink pack 10 that has reached the specific remaining ink level (step ST1). If no ink pack 10 has reached the specific remaining ink level, the inkjet printer 1 goes to the normal operating mode in which the first pressure control unit 56 controls driving the pressure pump 15, and enters the idle state waiting for print data.

When the communication unit 41 receives print data from an external device (step ST2), the first pressure control unit 56 checks if the pressure of the pressure pump 15 is less than or equal to first reference pressure Q1 (step ST3). More specifically, the first pressure control unit 56 determines if the second signal is output by the pressure sensor 24.

When the second signal is output from the pressure sensor 24, that is, when the pressure of the pressure pump 15 is the first reference pressure Q1 or less (in FIG. 7 step ST3 returns YES), the first pressure control unit 56 drives the pressure pump 15 until first set pressure P1 is reached, and then stops the pressure pump 15 (step ST4). More specifically, the first pressure control unit 56 drives the pressure pump 15 until the first signal is output from the pressure sensor 24, and then stops the pressure pump 15. As a result, the second signal is no longer output from the pressure sensor 24. When the second signal is no longer output, the print control unit 50 determines that the pressure of the pressure pump 15 exceeds the reference pressure (first reference pressure Q1), and starts printing the print data (step ST5).

If the pressure of the pressure pump 15 exceeds the first reference pressure Q1 in step ST3 (in FIG. 7, step ST3 returns NO), the second signal is not output from the pressure sensor 24. Therefore, the print control unit 50 determines that the pressure of the pressure pump 15 exceeds the reference pressure (first reference pressure Q1) and starts printing the print data (step ST5). More specifically, the print data is printed without the first pressure control unit 56 driving the pressure pump 15 (step ST5).

If the remaining ink calculator 52 detects in step ST1 that there is an ink pack 10 in which the amount of ink remaining in the ink pack 10 has reached the specific remaining ink level, the inkjet printer 1 enters a near-end detection mode in which the second pressure control unit 57 controls driving the pressure pump 15, and enters an idle state waiting for print data.

If there is an ink pack 10 in which the remaining ink level in the ink pack 10 has reached the specific remaining ink level, the initial pressurization unit 58 drives the pressure pump 15 in the initial pressurization operation until the pressure of the pressure pump 15 reaches the second set pressure P2. More specifically, because the pressure of the pressure pump 15 will not be at the minimum pressure R1, which is higher than the first set pressure P1 , when an ink pack 10 that has reached the specific remaining ink level is detected (step ST6), the initial pressurization unit 58 drives the pressure pump 15 until the second set pressure P2 is reached, and then stops the pressure pump 15 (step ST7).

When the communication unit 41 then receives print data supplied from an external device (step ST8), the second pressure control unit 57 checks if the estimated pressure of the pressure pump 15 is less than or equal to second reference pressure Q2 (step ST9).

If the estimated pressure is less than or equal to second reference pressure Q2 in step ST2 (in FIG. 8 step ST9 returns YES), the second additional pressurization unit 60 executes a second additional pressurization operation that drives the pressure pump 15 to raise the estimated pressure to the second set pressure P2 (step ST10). When the pressure pump 15 stops in step ST10, the estimated pressure has reached the second set pressure P2. More specifically, the estimated pressure exceeds the reference pressure (second reference pressure Q2) used as a basis for the print control unit 50 to start printing. The print control unit 50 therefore starts printing the print data (step ST5). However, if in step ST9 the estimated pressure exceeds the second reference pressure Q2 (in FIG. 8 step ST9 returns NO), the print control unit 50 starts printing the print data (step ST5). More specifically, the print data is printed without the second pressure control unit 57 driving the pressure pump 15.

When the pressure pump 15 stops in step ST7, the pressure estimating unit 55 calculates the pressure of the pressure pump 15 at a regular interval as the estimated pressure. If print data is not supplied after step ST7, the estimated pressure is compared with the minimum pressure R1 each time the pressure estimating unit 55 calculates the estimated pressure (step ST11, step ST6).

When the estimated pressure is detected to be the minimum pressure R1 or less in step ST6 (in FIG. 8 step ST6 returns YES), the first additional pressurization unit 59 executes the first additional pressurization operation to drive the pressure pump 15 until the estimated pressure reaches the second reference pressure Q2. As a result, the pressure of the pressure pump 15 is prevented from dropping to the minimum pressure R1.

The effect of the disclosure is described below.

(1) When the remaining ink in the ink pack 10 reaches the specific remaining ink level and the back pressure of the ink pack 10 rises, this embodiment of the disclosure increases the pressure of the pressure pump 15 from a first set pressure P1 to a second set pressure P2. Ink in the ink pack 10 can therefore be pumped to the ink path 4 side despite the rise in back pressure on the ink pack 10. The amount of ink left in the ink pack 10 can therefore be reduced without feeding ink into the ink path 4. Because the pressure pump 15 is driven at a high pressure level only after the remaining ink in the ink pack 10 drops to a specific remaining ink level, driving the pressure pump 15 for a long time can be prevented and shortening the service life of the pressure pump 15 can be prevented.

(2) The second set pressure P2 is set in this embodiment irrespective of deviation in regulator 25 operation and deviation in pressure pump 15 operation. As a result, the second set pressure P2 can be set high, the pressure urging the ink pack 10 can be increased, and the amount of ink left in the ink pack can be minimized.

(3) Because an estimated pressure value is used as the pressure of the pressure pump 15, driving the pressure pump 15 can be controlled after the remaining ink in the ink pack 10 reaches the specific remaining ink level without providing a new pressure sensor 24. The pressure of the pressure pump 15 can therefore be kept high after the remaining ink in the ink pack 10 reaches the specific remaining ink level. The estimated pressure can also be accurately calculated in this embodiment because the change-in-pressure information 61 obtained from actual measurements is used to calculate the estimated pressure.

(4) This embodiment handles the pressure of the pressure pump 15 based on an estimated pressure value that is calculated from the pressurization operation of the pressure pump 15 (the number of times the bellows pump 21 is operated), the time past since the pressurization stop time (the time the pressurization operation stopped), and the amount of ink used by the inkjet head 2. Driving the pressure pump 15 can therefore be controlled after the remaining ink in an ink pack 10 goes to the specific remaining ink level without providing a new pressure sensor 24. The pressure of the pressure pump 15 can therefore be kept high after the remaining ink in the ink pack 10 reaches the specific remaining ink level.

(5) Because the pressure pump 15 is driven to increase the pressure when the estimated pressure reaches the minimum pressure R1, the pressure of the pressure pump 15 can be prevented from going below the minimum pressure R1. The drive time t for which the pressure pump 15 is driven until the estimated pressure rises to the second set pressure P2 after the estimated pressure goes to the minimum pressure R1, that is, the drive time for raising the pressure of the pressure pump 15 from minimum pressure R1 to a pressure sufficient to pressure feed ink into the ink path, is shorter than the printer preparation time, that is, the time from when print data is received until the inkjet head 2 starts printing the print data. Printing the print data can therefore start without delay when print data is received.

(6) When the pressure of the pressure pump 15 is high (second set pressure P2), the pressure drops more easily over time than when the pressure of the pressure pump 15 is low (first set pressure P1). This embodiment of the disclosure therefore drives the pressure pump 15 until the estimated pressure rises to the second set pressure P2 if the estimated pressure is at the second reference pressure Q2, which is lower than second set pressure P2 and higher than minimum pressure R1, when print data is received from an external device. The pressure of the pressure pump 15 can therefore be prevented from dropping drastically while printing print data.

Other Embodiments

Figure 9:
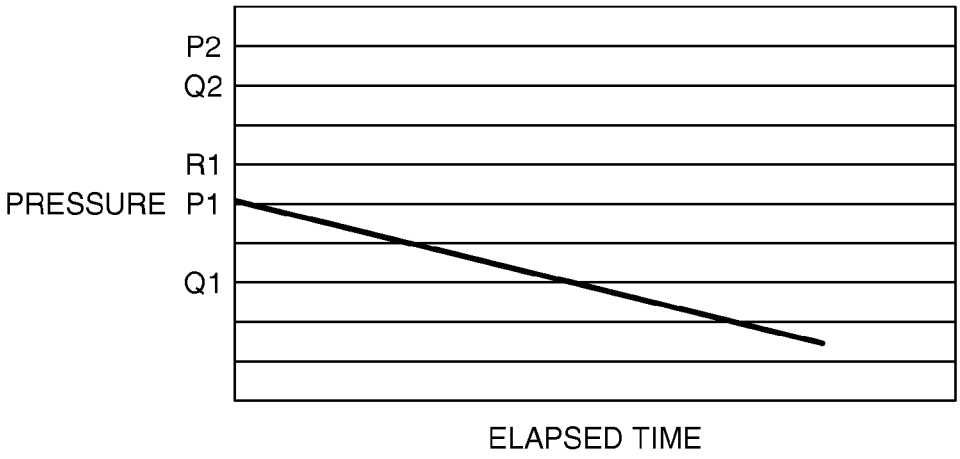
FIG. 9 is a graph showing the change in pressure over time after the pressure pump is set to a first set pressure.

Another embodiment of the disclosure is described below with additional reference to FIG. 9. FIG. 9 is a graph of the change-in-pressure information after the pressure pump is set to the first set pressure. Note that like parts and content in this and the embodiment described above are identified by like reference numerals, and further description thereof is omitted.

In the normal operating mode when the ink in the ink pack 10 is not near the near-end level, the first pressure control unit 56 controls driving the pressure pump 15 based on a first signal and a second signal from the pressure sensor 24. In this embodiment, the first pressure control unit 56 can control driving the pressure pump 15 based on the estimated pressure calculated by the pressure estimating unit 55 even in the normal operating mode.

In this embodiment, the first pressure control unit 56 has an initial pressurization unit 58, first additional pressurization unit 59, and second additional pressurization unit 60 similarly to the second pressure control unit 57 described above.

When the inkjet printer 1 turns on and the remaining ink calculator 52 does not detect the specific remaining ink level, the initial pressurization unit 58 drives the pressure pump 15 until the first signal is output from the pressure sensor 24, executes the initial pressurization operation until the pressure of the pressure pump 15 reaches the first set pressure P1 , and then stops the pressure pump 15.

When the estimated pressure calculated by the pressure estimating unit 55 goes to or below this minimum pressure R2 (second pressure), the first additional pressurization unit 59 executes the first additional pressurization operation to drive the pressure pump 15 until the estimated pressure reaches the first set pressure P1. The minimum pressure R2 is set so that the drive time the pressure pump 15 is driven to increase the pressure from minimum pressure R2 to first set pressure P1 is shorter than the printing preparation time required for the inkjet head 2 to start printing print data after the print data is received. Note that the minimum pressure R2 could be set lower than the first reference pressure Q1, or the first reference pressure Q1 can be set to the same value as the minimum pressure R2.

If the estimated pressure calculated by the pressure estimating unit 55 is less than or equal to first reference pressure Q1 when print data is received, the second additional pressurization unit 60 executes the second additional pressurization operation to drive the pressure pump 15 until the estimated pressure reaches the first set pressure P1.

The change-in-pressure information 61 that is used by the pressure estimating unit 55 while the first pressure control unit 56 controls driving the pressure pump 15 relates the actually measured pressure of the pressure pump 15, which drops from the time the pressure pump 15 stops after the pressure pump 15 is driven until the pump pressure reaches the first set pressure P1 and the pressure pump 15 is then stopped, to the change in the pressure of the pressure pump 15 and the time past from when the pressure pump 15 stopped operating. The change-in-pressure information 61 in this embodiment appears as shown in FIG. 9 when plotted on a graph.

The pressure estimating unit 55 then calculates the pressure of the pressure pump 15 at a regular interval based on the change-in-pressure information 61 shown in FIG. 9, ink use after the pressure pump 15 stops generating pressure, and the pressurization operation of the pressure pump 15 (first additional pressurization operation, second additional pressurization operation).

This embodiment of the disclosure can determine the pressure of the pressure pump 15 as the estimated pressure once the pressure of the pressure pump 15 is detected based on output from the pressure sensor 24 when the power turns on. As a result, when print data is not supplied from an external device for a specific time and the inkjet printer 1 enters a power conservation mode that stops power supply to the paper feed motor 43 and pressure sensor 24 and operates only the CPU or other control unit 40, the control unit 40 can still know the pressure of the pressure pump 15 while the power conservation mode is active and can control driving the pressure pump 15.

Therefore, while the pressure of the pressure pump 15 may drop greatly below the first reference pressure Q1 over time when operation in the power conservation mode continues for a long time, this embodiment of the disclosure continues to drive the pressure sensor based on the estimated pressure, and can prevent the pressure of the pressure pump 15 from going below the minimum pressure R2 while in the power conservation mode.

The disclosure being thus described, it will be obvious that it may be varied in many ways. Such variations are not to be regarded as a departure from the spirit and scope of the disclosure, and all such modifications as would be obvious to one skilled in the art are intended to be included within the scope of the following claims.

What is claimed is:

1. An ink supply control method of an inkjet printer that pressurizes an elastic ink pack containing ink with a pressure pump and supplies the ink to an ink path communicating with an inkjet head, the control method comprising steps of:

executing a pressurization operation that drives the pressure pump until the pressure of the pressure pump reaches a predetermined set pressure;

stopping the pressure pump;

measuring an elapsed time from a pressurization end time when the pressure pump stops, and determining ink use by the inkjet head since the pressurization end time;

calculating the pressure of the pressure pump from the pressurization end time at a specific interval as an estimated pressure based on the pressurization operation, the elapsed time, and the ink use; and driving the pressure pump until the estimated pressure reaches the predetermined set pressure when the estimated pressure goes to or below a minimum pressure that is lower than the set pressure.

2. The ink supply control method of an inkjet printer described in claim 1, further comprising steps of:

measuring actual pressure measurements of the pressure pump, which decreases from when the pressure pump stops;

storing the actual pressure measurements as change-in-pressure information relating the change in the pressure of the pressure pump to the time elapsed from when the pressure pump stops; and calculating estimated pressure based on the change-in-pressure information, the elapsed time, the ink use, and the pressurization operation of the pressure pump after the pressurization end time.

3. The ink supply control method of an inkjet printer described in claim 1, wherein:

a drive time during which the pressure pump is driven until the estimated pressure reaches the predetermined set pressure is shorter than a printing preparation time required for the inkjet head to start printing print data after print data is received.

4. The ink supply control method of an inkjet printer described in claim 1, further comprising a step of:

driving the pressure pump until the estimated pressure reaches the predetermined set pressure if the estimated pressure is at a reference pressure that is lower than the set pressure and higher than the minimum pressure when the print data is received from an external device.

5. The ink supply control method of an inkjet printer described in claim 1, further comprising steps of:

detecting whether ink remaining in an ink pack has reached a specific remaining ink level that is less than or equal to a preset remaining ink level;

setting the predetermined set pressure as a first pressure and the minimum pressure as a second pressure that is lower than the first pressure if the ink remaining in the ink pack has not reached the specific remaining ink level; and setting the minimum pressure to a third pressure that is higher than the first pressure, and setting the predetermined set pressure to a fourth pressure that is higher than the third pressure, if the ink remaining in the ink pack has reached the specific remaining ink level.

6. An inkjet printer having an elastic ink pack containing ink, and a pressure pump that pressurizes the ink pack and supplies the ink to an ink path communicating with an inkjet head, the inkjet printer comprising:

a pressure control unit configured to execute a pressurization operation to drive the pressure pump until the pressure of the pressure pump reaches a predetermined set pressure, and then stops the pressure pump;

a counter that measures an elapsed time from a pressurization end time when the pressure pump stops;

an ink usage counter that determines ink use by the inkjet head from the pressurization end time;

a pressure estimating unit configured to calculate the pressure of the pressure pump from the pressurization end time at a specific interval as an estimated pressure based on the pressurization operation, the elapsed time, and the ink use; and an additional pressurization control unit configured to drive the pressure pump until the estimated pressure reaches a set pressure that is higher than a minimum pressure when the estimated pressure goes to or below a preset minimum pressure.

7. The inkjet printer described in claim 6, further comprising:

a storage unit that stores change-in-pressure information obtained by measuring the actual pressure of the pressure pump, which decreases from when the pressure pump stops, wherein the change-in-pressure information relates a change in the pressure of the pressure pump to the elapsed time from when the pressure pump stops;

wherein the pressure estimating unit calculates the estimated pressure based on the change-in-pressure information, the elapsed time, the ink use, and the pressurization operation of the pressure pump after the pressurization end time.

8. The inkjet printer described in claim 6, wherein:

a drive time for which the additional pressurization control unit drives the pressure pump when the estimated pressure goes to the preset minimum pressure so that the estimated pressure rises to the set pressure is shorter than a printing preparation time required for the inkjet head to start printing the print data after the print data is received.

9. The inkjet printer described in claim 6, further comprising:

a communication unit configured to receive print data from an external device; and a second additional pressurization control unit configured to drive the pressure pump until the estimated pressure reaches the set pressure if the estimated pressure is at a reference pressure that is lower than the set pressure and higher than a minimum pressure limit when the print data is received.

10. The inkjet printer described in claim 6, further comprising:

a remaining ink monitor configured to detect whether the remaining ink in the ink pack has reached a specific remaining ink level that is less than or equal to a preset remaining ink level;

the pressure control unit including a first pressure control unit configured to set the set pressure as a first pressure, and set the minimum pressure as a second pressure that is lower than the first pressure if the remaining ink in the ink pack has not reached the specific remaining ink level, and a second pressure control unit configured to set the minimum pressure limit to a third pressure that is higher than the first pressure, and set the set pressure to a fourth pressure that is higher than the third pressure, if the remaining ink in the ink pack has reached the specific remaining ink level.

* * * * *